US007304421B2

(12) United States Patent
Mittler

(10) Patent No.: US 7,304,421 B2
(45) Date of Patent: Dec. 4, 2007

(54) POWER SUPPLY SYSTEM FOR A LAMP AND LAMP HAVING THIS POWER SUPPLY SYSTEM

(75) Inventor: Bodo Mittler, Stadtbergen (DE)

(73) Assignee: Patent-Treuhand-Gesellschaft für elecktrische Glühampen mbH, Munich (DE)

( * ) Notice: Subject to any disclaimer, the term of this patent is extended or adjusted under 35 U.S.C. 154(b) by 29 days.

(21) Appl. No.: 11/293,248

(22) Filed: Dec. 5, 2005

(65) Prior Publication Data

US 2006/0119275 A1 Jun. 8, 2006

(30) Foreign Application Priority Data

Dec. 6, 2004 (DE) ..... 10 2004 058 727

(51) Int. Cl.
*H01J 5/50* (2006.01)

(52) U.S. Cl. ..... 313/331; 313/573; 313/318.07; 439/619; 315/59

(58) Field of Classification Search ..... 313/271–274, 313/578–580, 573, 624, 634, 331, 318.1, 313/318.07, 318.09, 318.12, 63; 439/619, 439/699.2; 315/56, 58, 59
See application file for complete search history.

(56) References Cited

U.S. PATENT DOCUMENTS

| | | | | |
|---|---|---|---|---|
| 3,617,797 | A * | 11/1971 | Meijer et al. | 313/318.12 |
| 3,868,528 | A | 2/1975 | Lake | |
| 4,110,657 | A | 8/1978 | Sobieski | |
| 4,739,220 | A | 4/1988 | Dobrusskin | |
| 4,877,992 | A * | 10/1989 | Devir | 313/318.1 |
| 5,140,217 | A * | 8/1992 | Rao et al. | 313/274 |
| 6,075,318 | A * | 6/2000 | Noll et al. | 313/573 |
| 2006/0043899 | A1 * | 3/2006 | Mittler et al. | 313/634 |

FOREIGN PATENT DOCUMENTS

| | | |
|---|---|---|
| DE | 197 09 928 | 9/1998 |
| EP | 0 446 461 | 9/1991 |
| EP | 1 357 203 | 10/2003 |

* cited by examiner

*Primary Examiner*—Haissa Philogene
(74) *Attorney, Agent, or Firm*—William E. Meyer

(57) ABSTRACT

The subject matter of the disclosure is a power supply system for a lamp, having foils, which are embedded in a gas-tight manner in a pinch seal of the lamp and on which are arranged, in each case on two opposing narrow sides, an inner power supply line and an outer power supply line for the purpose of supplying power to a luminous element of the lamp, the outer power supply lines having lamp-side end sections, which are connected to the foils. According to the invention, the end sections of the outer power supply lines extend at least in sections approximately at right angles to a longitudinal axis of the foils.

1 Claim, 2 Drawing Sheets

POWER SUPPLY SYSTEM FOR A LAMP AND LAMP HAVING THIS POWER SUPPLY SYSTEM

TECHNICAL FIELD

The invention relates to electric lamps and particularly to electric lamps with pinch seals. More particularly the invention is concerned with the coupling of an outer lead to a seal foil in an electric lamp.

BACKGROUND ART

Such power supply systems are used, for example, for electrical current leadthroughs in pinch seals, made from quartz glass or hard glass, of halogen incandescent lamps, discharge lamps or the like.

Since the glass of the pinch seal has a substantially lower coefficient of thermal expansion than the power supply lines provided for supplying electrical power to a luminous means arranged within the lamp vessel, it is not possible to fuse the power supply lines directly in the glass of the pinch seal. The mechanical stresses resulting from the different coefficients of thermal expansion would lead to cracks and ultimately to premature failure of the lamp. For this reason, thin molybdenum foils having sufficient ductility are often used, and these molybdenum foils make gas-tight electrical power supply possible despite the different coefficients of thermal expansion of the glass and the molybdenum. With such solutions, for example that known from U.S. Pat. No. 6,075,318, in each case the two opposing ends of the molybdenum foils are welded to an inner and an outer power supply wire made from molybdenum, and the resultant power supply system is positioned in the lamp vessel end such that the inner power supply lines protrude into the interior of the lamp vessel, and the outer power supply lines protrude out of said lamp vessel. Subsequently, the glass at the lamp vessel end is heated and is pinched, for example by means of pinching jaws, with the power supply system in a gas-tight manner to form a pinch seal. The molybdenum foil on the one hand is used to produce the electrically conductive connection between the luminous means arranged within the lamp vessel and the power supply lines and, on the other hand, ensures a gas-tight seal of the lamp vessel.

It has been shown that the molybdenum foils and power supply lines, in particular in the case of lamps having a high thermal load, tend towards the formation of molybdenum oxides, for example $MoO_2$, $MoO_3$, the oxides initially forming on the outer power supply lines and then progressing to the molybdenum foils. Owing to this temperature-dependent oxide formation, the volume of the mentioned components increases and causes a significant increase in stress in the pinch seal which may lead to breakage and thus to premature failure of the lamp.

In order to improve the oxidation resistance and thus to increase the thermal loading capacity of the power supply system, it is known from the general prior art to apply a partial chromium plating. In this very work-intensive method, the power supply systems usually produced by resistance welding are embedded in a sand-like substrate up to the desired height of the chromium plating, for example 2 mm above the weld joint. Owing to a chemical reaction, partial chromium deposition takes place in the embedded region in an environmentally harmful process. The chromium layer formed improves the oxidation resistance and thus leads to an increase in the thermal loading capacity of the lamps. Disadvantages in such power supply systems are firstly that, owing to an insufficient sealing effect in the chromium-plated region, the effective sealing length of the molybdenum foils is reduced and, as a result, the sealing effect of the pinch seal is impaired with reduced life of the lamp and, secondly, the coating process is not only environmentally harmful but is also complex and cost-intensive owing to the largely manual production process. One further disadvantage is the fact that the outer power supply lines can easily break out of the pinch seal owing to axial tensile forces.

DISCLOSURE OF THE INVENTION

The invention is based on the object of providing a power supply system for a lamp which makes possible, compared to conventional solutions, increased thermal loading capacity with reduced production complexity and improved support of the outer power supply lines in the lamp.

This object is achieved according to the invention by a power supply system for a lamp, having foils, which are embedded in a gas-tight manner in a pinch seal of the lamp and on which are arranged, in each case on two opposing narrow sides, an inner power supply line and an outer power supply line for the purpose of supplying power to a luminous means of the lamp, the outer power supply lines having lamp-side end sections and being connected to the foils via said end sections, whereby the end sections of the outer power supply lines extend at least in sections approximately at right angles to a longitudinal axis of the foils.

In addition, protection is claimed for a lamp having the power supply system according to the invention.

The power supply system according to the invention for a lamp has foils, which are embedded in a gas-tight manner in a pinch seal of the lamp and on which are arranged, in each case on two opposing narrow sides, an inner power supply line and an outer supply line for the purpose of supplying power to a luminous means of the lamp, the outer power supply lines having lamp-side end sections and being connected to the foils via said end sections.

According to the invention, the end sections of the outer power supply lines extend at least in sections approximately at right angles to a longitudinal axis of the foils. As a result, the distance between the luminous means and the connection point between the outer power supply line and the foil increases. Owing to the increased distance, the thermal load on the connection is reduced since the temperature falls as the distance from the luminous means increases. As a result, it is possible to dispense with the chromium plating required in the prior art for improving the thermal loading capacity, and the sealing length of the foils is increased. Furthermore, there is improved support of the outer power supply lines in the pinch seal owing to the mechanical anchoring of the end sections in the glass since the end sections, which are bent at right angles, of the outer power supply lines have the heated glass flowing behind them during the pinch-sealing process and are fixed in an interlocking manner in the pinch seal.

The end sections of the outer power supply lines are preferably bent towards one another and lie approximately on one axis. This results in a compact arrangement of the power supply lines and a defined distance between the foils and the power supply lines.

The length of the end sections is advantageously designed to be smaller than the width of the foils.

In accordance with one particularly preferred exemplary embodiment, the outer power supply lines of the power supply system have a flattened region at least in sections. As a result, an increased contact area between the power supply line and the foil is made possible, and weldability is improved. In addition, the oxidation resistance and thus the temperature resistance of the power supply system are further improved since the flattened end sections are embedded particularly well in the glass. The outer power supply lines can be flattened, for example, in one working step by resistance welding using the force applied by the electrodes or in a die. The junction with the flattened region may be outside or inside the pinch seal of the lamp.

The flattened region preferably has a thickness in the range from approximately 0.1 to 0.8 mm.

It has proven particularly advantageous to form the power supply lines and foils from molybdenum.

The connection between the end sections and the foil preferably takes place by means of welding, in particular by means of resistance welding.

The flattened region of the outer power supply lines and the foil advantageously form essentially one plane after welding. That is to say complete planarization of the foil on the flattened region is achieved and stresses at the junction between the foil and the power supply lines are avoided by a suitable selection of the welding parameters, such as power supplied and force applied. For this purpose, a servomotor-driven welding device is preferably used.

BRIEF DESCRIPTION OF THE DRAWINGS

The invention will be explained in more detail below with reference to preferred exemplary embodiments. In the drawing.

BEST MODE FOR CARRYING OUT THE INVENTION

Figure 1:
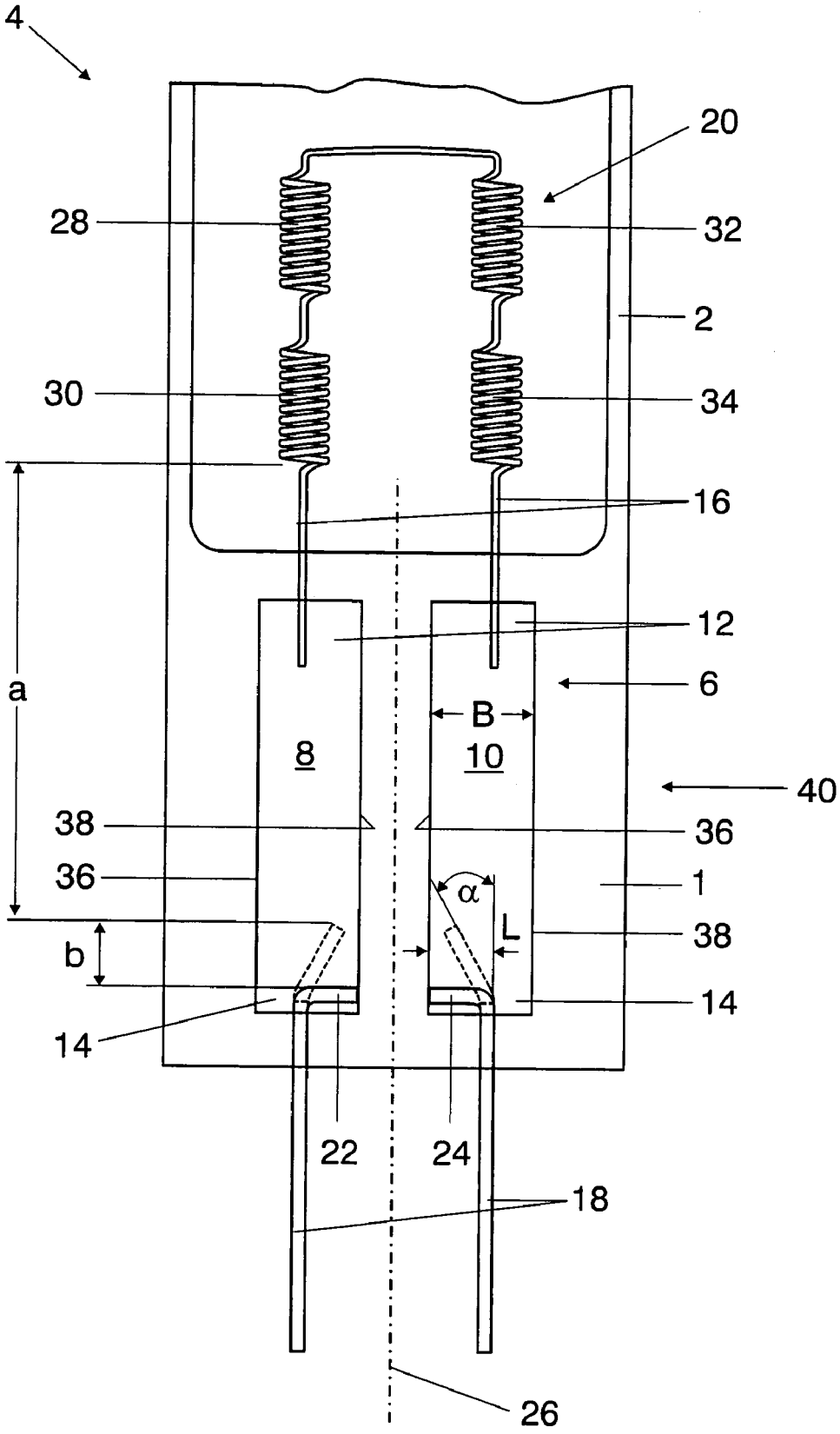
FIG. 1 shows a schematic illustration of a plan view of a first exemplary embodiment according to the invention of a power supply system.

FIG. 1 shows a pinch seal 1 of a lamp vessel 2, made from quartz glass, of an electric lamp 4, which has a power supply system 6 according to the invention.

The power supply system 6 has two approximately rectangular molybdenum foils 8, 10, which are embedded in a gas-tight manner in the pinch seal 1 of the lamp 4 and on which are arranged, in each case on two opposing narrow sides 12, 14, an inner power supply line 16 and an outer power supply line 18 for the purpose of supplying power to a luminous means 20 of the lamp 4. The outer power supply lines 18, which are likewise made from molybdenum, have lamp-side end sections 22, 24 and are welded to the molybdenum foils 8, 10 via said end sections 22, 24. According to the invention, the end sections 22, 24 of the outer power supply lines 18 are bent towards one another at right angles to a longitudinal axis 26 of the molybdenum foils 8, 10. As a result, the distance a between the luminous means 20, formed, for example, from four filament sections 28, 30, 32, 34, and the thermally critical connection point between the outer power supply line 18 and the molybdenum foil 8, 10 is increased by an amount b in comparison to the conventional connection (indicated by dashed lines) having a substantially smaller bending angle $\alpha$. Owing to the distance, increased by the amount b, the thermal load on the connection is reduced since the temperature falls as the distance from the luminous means 20 increases. As a result, it is possible to dispense with the work-intensive chromium plating required in the prior art for improving the thermal loading capacity, and the overall length of the molybdenum foils 8, 10 is maintained as an effective sealing length. Furthermore, the support of the outer power supply lines 18 in the pinch seal 1 is improved owing to the mechanical anchoring of the end sections 22, 24 in the glass since said end sections 22, 24 have the heated glass flowing behind them during the pinch-sealing operation and are fixed in an interlocking manner.

The molybdenum foils 8, 10 used each have an approximately rectangular basic shape, whose boundary is formed by the mutually opposing narrow sides 12, 14 and by two side edges 36, 38 extending in the direction of the longitudinal axis 26, perpendicularly to the narrow sides. The surface of the molybdenum foils 8, 10 is convexly curved, its thickness continuously decreasing, starting from its longitudinal axis to the two side edges 36, 38, such that the molybdenum foils 8, 10 form an approximately lanceolate cross section and, as a result, make possible a homogenous stress profile in the pinch seal 1.

In order to produce the power supply system 6, the two rectangular molybdenum foil pieces 8, 10 are cut away from a molybdenum strip arranged on a supply reel. In the following working step, in each case an inner power supply line 16 and an outer power supply line 18 are welded to the two opposing narrow sides 12, 14 of the molybdenum foil pieces 8, 10 for the purpose of supplying power to the luminous means 20 of the lamp 4. The power supply system 6 prefabricated in this manner is then inserted into the lamp vessel end 40, which is to be sealed in a gas-tight manner, and the quartz glass is softened in this region by heating and pressed by means of pinching jaws and sealed in a gas-tight manner. After cooling of the quartz glass, the power supply system 6, comprising power supply lines 16, 18 and molybdenum foils 8, 10, forms an electrical current leadthrough for the luminous means 20 of the lamp 4, which is fused into the pinch seal 1 in a gas-tight manner with high strength.

Figure 2:
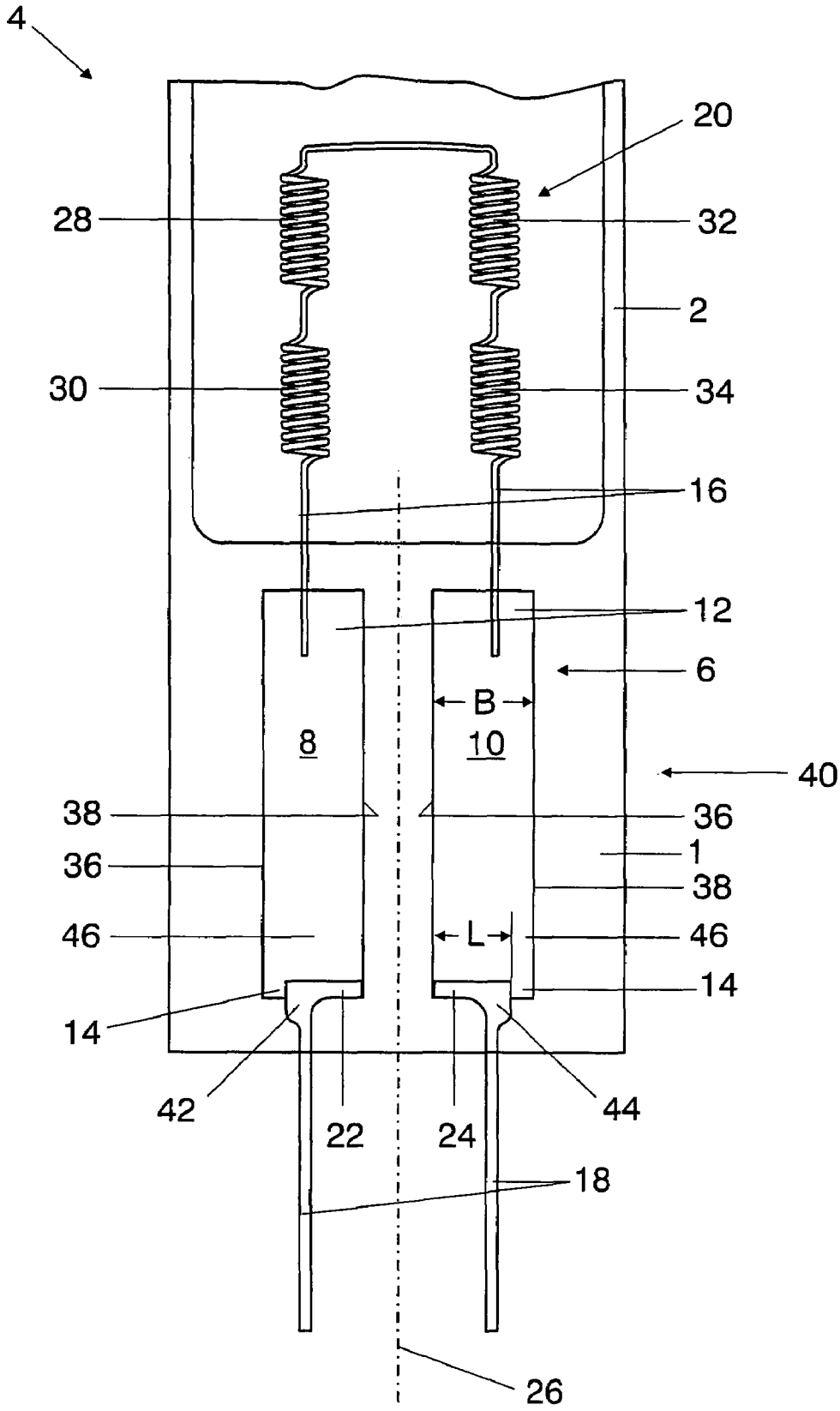
FIG. 2 shows a schematic illustration of a plan view of a further exemplary embodiment of a power supply system according to the invention.

In accordance with FIG. 2, which shows a plan view of a further exemplary embodiment of a power supply system 6 according to the invention, the outer power supply lines 18 have a flattened region 42, 44 in sections, which region begins even before the connection point to the molybdenum foil 8, 10. In the exemplary embodiment shown, this region lies within the pinch seal 1 of the lamp 4 and makes possible an enlarged contact area between the outer power supply lines 18 and the molybdenum foils 8, 10 and, as a result, improved welding. Since the flattened end sections 42, 44 are embedded particularly well in the pinch seal 1 owing to their flat shape, the oxidation resistance, and thus also the temperature resistance, of the power supply system 6 are improved, in addition to the advantages mentioned in relation to FIG. 1 of the end sections 22, 24 bent at right angles.

In order to simplify production, the outer power supply lines 18 are flattened in one working step by resistance welding owing to the force applied by the welding electrodes. By a suitable selection of the welding parameters, such as the power supplied and the force applied, the flattened regions 42, 44 of the outer power supply lines 18 and the molybdenum foil 8, 10 form a common plane 46 after welding. As a result, stresses at the junction between the ends of the molybdenum foil 8, 10 and power supply lines 18 are avoided during and after the embedding process in the pinch seal 1. The power supply system 6 prefabricated in this manner is then inserted into the lamp vessel end 40, the quartz glass is softened by heating in this region and is pressed by means of pinching jaws and sealed in a gas-tight manner. After cooling of the quartz glass, the power supply system 6 forms an electrical current leadthrough, which is embedded in the pinch seal 1 in a gas-tight manner with high strength.

The subject matter of the disclosure is a power supply system 6 for a lamp 4 having foils 8, 10, which are embedded in a gas-tight manner in a pinch seal 1 of the lamp 4 and on which are arranged, in each case on two opposing narrow sides 12, 14, an inner power supply line 16 and an outer power supply line 18 for the purpose of supplying power to a luminous means 20 of the lamp 4, the outer power supply lines 18 having lamp-side end sections 22, 24, which are connected to the foils 8, 10. According to the invention, the end sections 22, 24 of the outer power supply lines 18 extend at least in sections approximately at right angles to a longitudinal axis 26 of the foils 8, 10.

What is claimed is:

1. A lamp comprising:

an envelope defining an enclosed volume, the envelope having a pinch seal;

an electrical light source positioned in the enclosed volume having at least one inner power supply line having an end portion extended into the pinch seal;

a metal foil enclosed in the pinch seal, and longitudinally extended between an inner end and an outer end, the inner end of the metal foil being electrically coupled to the end portion of the inner power line; and an outer power supply line extended into the pinch seal, and having an end portion extending transversely to the longitudinal extension of the metal foil and electrically coupled along such transversely extended end portion to the metal foil adjacent the outer end of the metal foil.

* * * * *